US005932971A

United States Patent [19]

Goebel et al.

[11] Patent Number: 5,932,971

[45] Date of Patent: Aug. 3, 1999

[54] OPTIMALLY DESIGNED TRAVELING WAVE TUBE FOR OPERATION BACKED OFF FROM SATURATION

[76] Inventors: Dan M. Goebel, 4637 Lindley Ave., Tarzana, Calif. 91356; Edward A. Adler, 8018 Nardian Way, Los Angeles, Calif. 90045

[21] Appl. No.: 08/869,841

[22] Filed: Jun. 5, 1997

[51] Int. Cl.[6] ..... H01J 25/34; H01J 23/087

[52] U.S. Cl. ..... 315/3.5; 315/5.35

[58] Field of Search ..... 315/3.5, 5.35, 315/39.3

[56] References Cited

U.S. PATENT DOCUMENTS

| | | | |
|---|---|---|---|
| 3,433,999 | 3/1969 | Espinosa | 315/3.5 |
| 3,684,913 | 8/1972 | James et al. | 315/3.5 |
| 3,825,794 | 7/1974 | Butwell | 315/3.5 X |
| 5,274,304 | 12/1993 | Nishida | 315/3.5 |

*Primary Examiner*—Benny T. Lee

*Attorney, Agent, or Firm*—Terje Gudmestad; Georgann Grunebach; Michael W. Sales

[57] ABSTRACT

A traveling wave tube and method of operation is disclosed. The traveling wave tube includes a slow wave structure such as a helix member provided with input and output ends and located within a tube member. An electron gun assembly is adjacent the input end for injecting electrons as an electron beam along an axial path through the helix member. A magnetic focusing device generates a magnetic field having a given strength to confine the beam to the axial path. The given strength of the magnetic field is sufficient to confine the beam only when the power level of the microwave input signal is selected such that the given power level of the microwave output signal is at least 6 dB lower than the power level of the microwave output signal at saturation. Boron Nitride (BN) supporting rods are engaged between the tube and helix members for supporting and transferring heat away from the helix member.

11 Claims, 3 Drawing Sheets

OPTIMALLY DESIGNED TRAVELING WAVE TUBE FOR OPERATION BACKED OFF FROM SATURATION

TECHNICAL FIELD

The present invention relates generally to traveling wave tubes and, more particularly, to a traveling wave tube running backed off from saturation and having heat transferring and magnetic focusing components which are only suitable for the backed off operation.

BACKGROUND ART

A traveling wave tube is a vacuum device which serves as an amplifier of microwave frequency energy. It relies upon the interaction that occurs between an electron beam and a microwave signal. An electron gun at an input end of a slow wave structure (SWS) generates the electron beam. The electron beam travels along an axial path formed by the SWS. A microwave source inputs the microwave signal at the input end of the SWS. The microwave signal then propagates along the SWS toward an output end of the SWS.

The SWS causes the microwave signal to traverse an extended distance between two axially spaced points. This reduces the effective lateral propagation velocity of the microwave signal from that of light to that of the electron beam. Interaction between the electron beam and the microwave signal causes velocity modulation and bunching of the electrons in the beam. The interaction causes energy coupling to take place between the electron beam and the microwave signal that amplifies the signal. The amplified signal is then coupled out at the output end of the SWS.

Because of the close proximity between the electron beam and the SWS, part of the beam impinges the SWS and produces heat. The amount of heat generated also depends on the power of the electron beam and the microwave signal. If the traveling wave tube cannot remove the heat fast enough, the tube reaches a fairly high temperature. This fairly high temperature increases electrical resistance losses of the SWS and promotes the generation of gas. This, in turn, results in deterioration of the amplified microwave signal as well as of the electron beam transmission. Moreover, these undesirable phenomena reduce the service life of the traveling wave tube.

To mitigate the effects of heat, the traveling wave tube includes supporting rods to conduct the heat away from the SWS to a tube member which encloses the SWS. The supporting rods extend longitudinally adjacent the SWS and are located between the SWS and the tube member. In addition to conducting heat, the supporting rods support the SWS in the tube member.

Due to perturbance of the microwave signal on the electron beam and space charge effects arising from mutual repulsion between adjacent electrons, the beam tends to increase in diameter along the SWS. Thus, the traveling wave tube further includes a magnetic focusing device for constraining the electron beam along the axial path through the SWS to prevent excessive impingement of the electrons on the SWS. The magnetic focusing device generates a magnetic field which confines the electron beam.

A typical focusing device is a periodic permanent magnet (PPM) arrangement. The PPM arrangement includes a plurality of like short annular permanent magnets disposed in axial alignment along and about the SWS. A plurality of annular ferromagnetic pole pieces are interposed between and abut adjacent magnets. The magnets are magnetized axially and arranged with like poles of adjacent magnets confronting one another.

The amount of coupling between the electron beam and the microwave signal is approximately constant at low microwave signal input power levels. Thus, the gain between the microwave output and input signals is nearly constant. As the power of the microwave input signal increases, nonlinear effects become more significant. Eventually, the microwave output signal reaches a maximum power value and the traveling wave tube operates at saturation.

Approaching saturation, the gain between the microwave output and input signals starts to decline. If the power of the microwave input signal is increased further beyond saturation, the power of the microwave output signal and the gain decrease. A traveling wave tube operating below its saturated microwave output power is described as running backed off from saturation.

The power of the microwave output signal is also proportional to the electron beam power. Thus, saturation of the traveling wave tube occurs, regardless of the power of the microwave input signal, when the microwave output signal power is roughly 25% to 30% of the electron beam power.

The magnetic field strength of the PPM arrangement required for confining the electron beam is a function of the power of the microwave output signal. For instance, at saturation, the microwave signal significantly perturbs and effects the electron beam. Because of the significant perturbance and the space charge mutual repulsion effect, some of the electrons in the electron beam develop large radial velocity components. Accordingly, a strong magnetic field generated by a large number of magnets is needed to nullify the radial velocity components so that the electrons travel generally axially through the SWS without impinging the SWS.

On the other hand, running backed off saturation, the effect of the microwave signal on the electron beam is minimal. Thus, a weak magnetic field generated by some magnets is sufficient to nullify the radial velocity components caused by the space charge effects.

Typical traveling wave tubes are built to produce the desired saturated microwave output power and then are operated backed off from saturation to obtain the desired amplitude and phase linearity. This requires that the supporting rods be able to handle the full heat load generated by the electron beam and the microwave signal at saturation. The PPM arrangement also has to able to confine the electron beam at saturation. A primary disadvantage with typical traveling wave tubes is that if the tubes continuously run backed off from saturation, then the full capabilities of the supporting rods and the PPM arrangement are never utilized and are, therefore, not needed.

SUMMARY OF THE INVENTION

Accordingly, it is an object of the present invention to provide a traveling wave tube providing superior amplitude and phase linearity and having heat transferring and magnetic focusing components which are only suitable for backed off operation.

In carrying out the above object and other objects, the present invention provides a traveling wave tube. The traveling wave tube includes a SWS located within a tube member. The SWS is provided with an input end for receiving a microwave input signal having a selected power level and an output end for supplying a microwave output signal having a given power level. An electron gun assembly is adjacent the input end of the SWS for injecting electrons as an electron beam along an axial path in the SWS. A magnetic focusing device generates a magnetic field having a given strength to confine the electron beam to the axial path. The given strength of the magnetic field is sufficient to confine the electron beam only when the power level of the microwave input signal is selected such that the given power level of the microwave output signal is at least 6 dB lower than the power level of the microwave output signal at saturation.

Preferably, the SWS is a helix member and the traveling wave tube includes three Boron Nitride (BN) supporting rods engaged between the tube and helix members for supporting and transferring heat away from the helix member. The BN supporting rods have a laminated structure. The direction parallel and the direction perpendicular to the layers are referred to as the "A" and "C" directions, respectively. The three BN supporting rods are oriented in the "C" direction between the helix and tube members.

Further, in carrying out the above objects and other objects, the present invention provides a method for operating a traveling wave tube. The method is for a traveling wave tube provided with a SWS having an input end for receiving a microwave input signal having a selected power level and an output end for supplying a microwave output signal having a given power level.

The method includes injecting electrons at the input end of the SWS to form an electron beam along an axial path through the SWS. The microwave input signal having the selected power level is then applied to the input end of the SWS. A magnetic field having a given strength is then generated to confine the electron beam to the axial path. The given strength of the magnetic field is sufficient to confine the electron beam only when the power level of the microwave input signal is selected such that the given power level of the microwave output signal is at least 6 dB lower than the power level of the microwave output signal at saturation.

The advantages accruing to the present invention are numerous. The traveling wave tube is operated only at back off (at least 6 dB below saturation) to provide sufficient amplitude and phase linearity for multiple tone communications. At back off, a relatively smaller amount of heat is generated than the amount of heat generated at saturation. Thus, the traveling wave tube includes BN supporting rods oriented in the "C" instead of the "A" direction. The supporting rod size may be optimized to remove the minimal heat generated at back off. Furthermore, a weaker magnetic field and a corresponding reduced number of magnets can confine and focus the electron beam at back off. Magnets represent the dominant cost of the traveling wave tube. By reducing the magnetic field strength required for electron beam confinement, the cost of the traveling wave tube decreases significantly.

Another advantage of the present invention is that for a fixed gain, the length of the traveling wave tube may be shortened by specifying a high beam perveance. With a shorter traveling wave tube the magnetic field strength required for electron beam confinement may be reduced.

These and other features, aspects, and embodiments of the present invention will become better understood with regard to the following description, appended claims, and accompanying drawings.

BEST MODES FOR CARRYING OUT THE INVENTION

Figure 1:
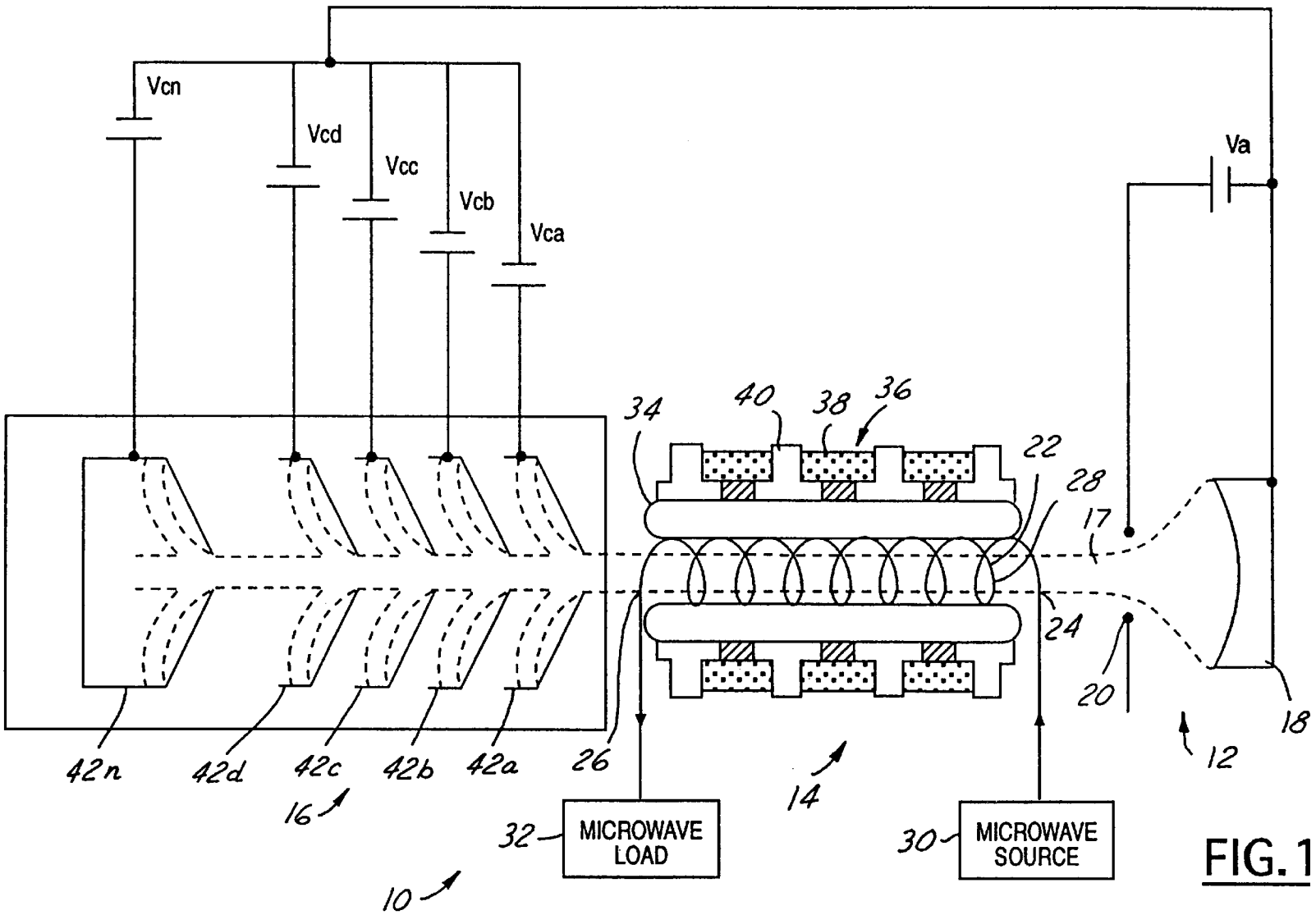
FIG. 1 is a perspective view of the traveling wave tube according to the present invention.
Figure 2:
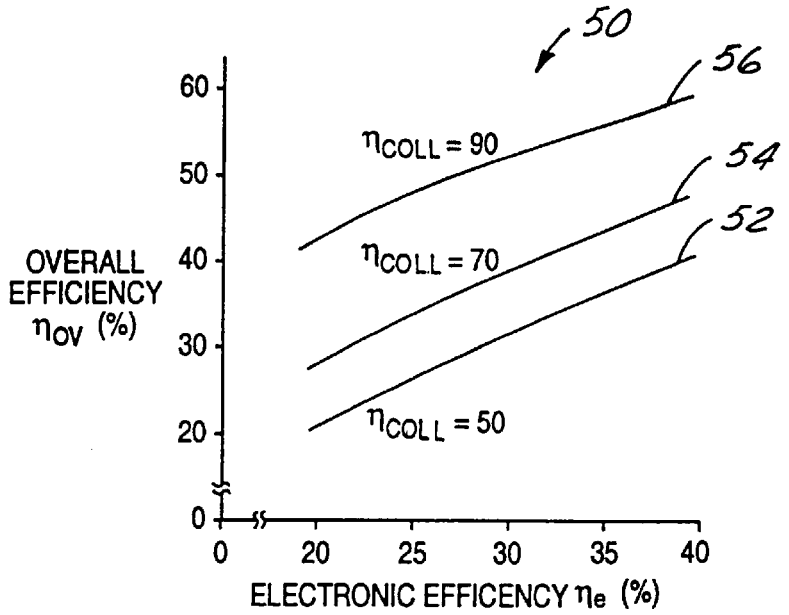
FIG. 2 is a schematic view of a traveling wave tube.

Referring now to FIGS. 1 and 2, a traveling wave tube 10 according to the present invention is shown. Traveling wave tube 10 includes an electron gun assembly 12, a slow wave structure (SWS) 14, and a collector assembly 16. Electron gun assembly 12 injects electrons to generate an electron beam 18. Electron gun assembly 12 includes a cathode 20 and an anode 22. A negative voltage $V_a$ is applied to cathode 20 and a corresponding positive voltage is applied to anode 22. Cathode 20 is the source of electrons for electron beam 18. A voltage $V_h$ is applied to heating element 24 which heats cathode 18 for thermionic emission of the electrons from the cathode. Anode 22 accelerates and focuses the electrons. The power of electron beam 18 depends on the cathode voltage $V_a$ and the cathode current I.

SWS 14 preferably is an electrically conductive helix member 26 preferably made of tungsten, molybdenum, or the like. Of course, SWS 14 may be a coupled-cavity circuit (not specifically shown) instead of helix member 26. Helix member 26 has an input end 28 and an output end 30. Electron gun assembly 12 is adjacent input end 28 and electron beam 18 travels along an axial path 32 of helix member 26 from input end 28 towards output end 30.

A microwave source 34 is connected to input end 28 for applying a microwave input signal to helix member 26. The microwave signal propagates along helix member 26. Helix member 26 causes the microwave signal to traverse an extended distance between two axially spaced points to reduce the effective lateral propagation velocity of the microwave signal to that of electron beam 18. By lowering the propagation velocity, energy coupling is caused to take place between electron beam 18 and the microwave signal that amplifies the signal. A microwave load 36 is connected to output end 30 for receiving an amplified microwave output signal from helix member 26.

Collector assembly 16 is adjacent output end 30 of helix member 26. Collector assembly 16 includes a number of collector electrodes 58*a*, 58*b*, 58*c*, 58*d*, 58*e–n*. Collector electrodes 58*a*, 58*b*, 58*c*, 58*d*, 58*e–n* collect electrons in electron beam 18 to recover the beam power which was not used in generating the microwave output signal. This power is referred to as the unused power in the spent electron beam. Some of the unused power is converted to heat by electrons striking collector electrodes 58*a*, 58*b*, 58*c*, 58*d*, 58*e–n*. Thus, bias voltages ($V_{ca}$, $V_{cb}$, $V_{cc}$, $V_{cd}$, and $V_{cn}$) are applied to respective collector electrodes 58*a*, 58*b*, 58*c*, 58*d*, 58*e–n* to slow down the electrons to enable the electrodes to recover more power and reduce heat power losses. Preferably, collector electrodes 58*a*, 58*b*, 58*c*, 58*d*, 58*e–n* comprise graphite to minimize the secondary electron yield.

Figure 3:
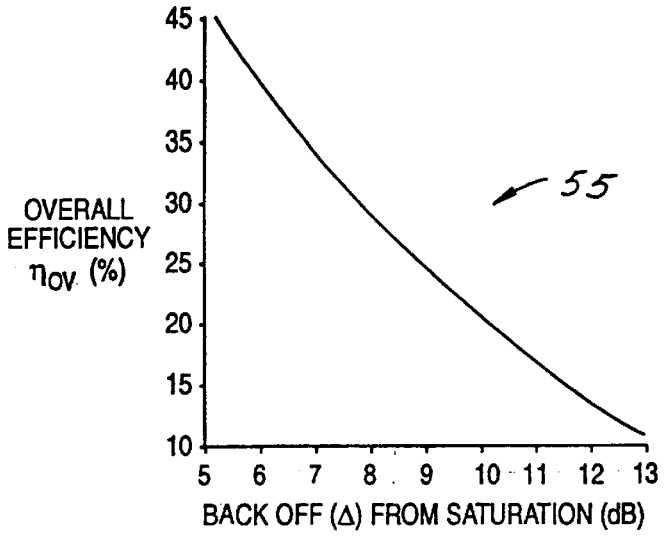
FIG. 3 is a partially cut away perspective view showing the structure of the traveling wave tube.
Figure 4:
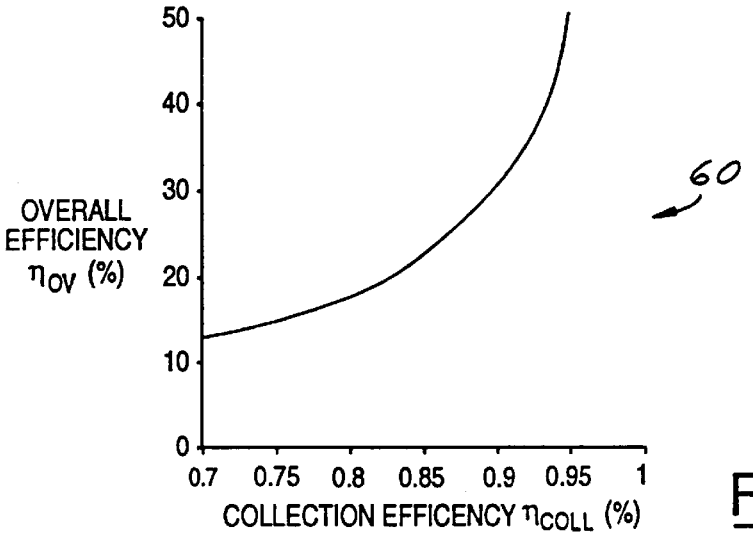
FIG. 4 is a cross-sectional view of the traveling wave tube shown in FIG. 3 along the line 4—4.

Referring now to FIGS. 3 and 4, with continuing reference to FIGS. 1 and 2, traveling wave tube 10 further includes a metal tube member 38 preferably made of stainless steel. Tube member 38 has an inner surface 40 forming an interior. Helix member 26 is located in the interior of tube member 38. Helix member 26 includes a number of turns 42 and extends along the longitudinal direction of tube member 38.

Traveling wave tube 10 further includes three Boron Nitride (BN) supporting rods 44 provided between inner surface 40 of tube member 38 and helix member 26. Each one of BN supporting rods 44 has an inner rod mating surface 46 for engaging the outer surface of helix member 26 and an outer rod mating surface 48 for engaging inner surface 40 of tube member 38. BN supporting rods 44 transfer heat away from helix member 26 to tube member 38 and then to the outside environment. BN supporting rods 44 also provide mechanical support to helix member 26 so that the helix member remains stationary with respect to tube member 38.

As shown best in FIGS. 1 and 2, SWS 14 includes a magnetic focusing device such as a periodic permanent magnet (PPM) arrangement 50. The magnetic focusing device also encompasses other alternatives such as a solenoid or a single permanent magnet. PPM arrangement 50 includes a plurality of permanent magnets 52 and a plurality of pole pieces 54. Permanent magnets 52 are inserted and stacked in a cell 56 between respective pole pieces 54 to provide sufficient magnetic flux to generate a magnetic field having a desired strength for confining electron beam 18.

The strength of the magnetic field is proportional to the strength of each magnet 52 (given by the BH energy product) and the number of magnets in each cell 56. The cost of PPM arrangement 50 is proportional to the BH product of each magnet 52 and the total number of magnets. Minimizing the desired magnetic field strength in traveling wave tube 10 reduces either the BH product and/or the total number of magnets and greatly minimizes the cost of the traveling wave tube.

The magnetic field strength of PPM arrangement 50 required for confining electron beam 18 is a function of the power of the electron beam and of the microwave signal. At saturation, the microwave signal significantly perturbs and effects electron beam 18. Accordingly, a strong magnetic field generated by a large BH product and/or a large number of magnets is needed to nullify the perturbance caused by the microwave signal.

Running backed off from saturation the perturbance and effect of the microwave signal on electron beam 18 is minimal. In fact, electron beam 18 has characteristics similar to the electron beam that occurs when microwave source 34 is shut off. When microwave source 34 is shut off and is not supplying a microwave input signal, the electron beam is referred to as a DC electron beam. A DC electron beam experiences no perturbance. Accordingly, a weak magnetic field generated by a small BH product and/or a small number of magnets is sufficient to nullify the minimal perturbance caused by the microwave signal at back off.

Traveling wave tube 10 is operated continuously at back off to obtain the desired amplitude and phase linearity required for multiple tone communication applications. The amount of back off is the difference in dB between the output power of the microwave output signal and the saturated microwave output power. Traveling wave tube 10 is operated continuously at least 6 dB below saturation. Preferably, traveling wave tube 10 is operated such that the microwave output power is 6 to 25 dB below the saturated microwave output power (or at least 1 dB below the gain compression point). The microwave output power is also roughly twenty to fifty times below the power of electron beam 18. Thus, the perturbance of the microwave signal on electron beam 18 is minimal.

Because of the minimal perturbance at back off, PPM arrangement 52 includes a small BH product and/or a small number of magnets which can generate a weak magnetic field sufficient to nullify the minimal perturbance, but insufficient to nullify the significant perturbance at saturation. In effect, instead of generating a strong magnetic field that can confine electron beam 18 at saturation, PPM arrangement 52 generates a weak magnetic field which is sufficient to confine the electron beam only at back off. The weak magnetic field is not capable of confining electron beam 18 at saturation.

Compared to saturation, backed off operation results in a nearly 50% reduction in the magnetic field strength required for confining the electron beam. Thus, unlike typical traveling wave tubes, the full capabilities of PPM arrangement 52 are utilized. Furthermore, because of the reduced cost associated with PPM arrangement 52, the cost of traveling wave tube 10 is much lower than the cost of typical traveling wave tubes.

The following illustrates the significant reduction in the strength of the magnetic field required for confining the electron beam at back off. The absolute minimum magnetic field strength required to confine the electron beam, called the Brillion field, $B_B$, is given by:

$$B_B = \frac{1}{r}\left[\frac{2I}{\pi\eta\epsilon_o u_o}\right]^{1/2} \tag{1}$$

where:

r is the beam radius,

I is the beam current, $\eta$ is the electron charge to mass ratio, $\epsilon_o$ is the free space permittivity, and $u_o$ is the beam velocity.

The magnetic field strength $B_c$ required to confine the electron beam in the presence of a microwave signal is given by:

$$B_C = mB_B = \frac{m}{r}\left[\frac{2I}{\pi\eta\epsilon_o u_o}\right]^{1/2} \tag{2}$$

where m is the confinement factor.

The confinement factor m is chosen such that the electron beam is prevented from approaching the helix member during interaction with the microwave signal. The confinement factor m is usually about a factor of two for operation at saturation. For a PPM arrangement focusing an electron beam, the field $B_c$ is the RMS (root mean squared) field of the periodic magnetic structure.

An example is a 1 $\mu$perv electron beam having a radius (r) of 1 mm at 7 kV. Thus, the beam current (I) is 0.57 A. From Equation 1, the minimum field strength $B_B$ is 685 Gauss. For a traveling wave tube operating at saturation with a typical confinement factor (m) of two, the field strength ($B_c$) required to confine the electron beam at saturation is 1370 Gauss.

For a traveling wave tube operating at least 6 dB backed off from saturation, the required RMS field ($B_c$) is 707 Gauss. This is nearly half of the normal field used for traveling wave tubes operating at saturation and represents an equivalent 50% reduction in the cost of magnets for a tube limited to operation at back off.

The cost and number of magnets may be reduced further by shortening the length of SWS 14 when the gain of traveling wave tube 10 is fixed. From small signal traveling wave tube theory according to J. R. Pierce, the length (L) of a helix member is proportional to the gain divided by the cube root of the perveance (P) of the electron beam.

$$L \sim \frac{\text{Gain}}{P^{1/3}} \tag{3}$$

Preferably, the gain of traveling wave tube 10 is always less than 40 dB. With a relatively small gain, the length of SWS 14 may be shortened.

For a fixed gain, the length may be further shortened by specifying a high perveance. Preferably, the perveance of traveling wave tube 10 is set at a relatively high value of at least 0.5 $\mu$perv.

Thus, with a small gain and a high perveance, the length of SWS 14 may be minimized. Minimizing the length of SWS 14 reduces the BH product and/or the number of magnets required to confine electron beam 18. As stated before, the cost of the magnets represents the dominant cost of a traveling wave tube.

Figure 5:
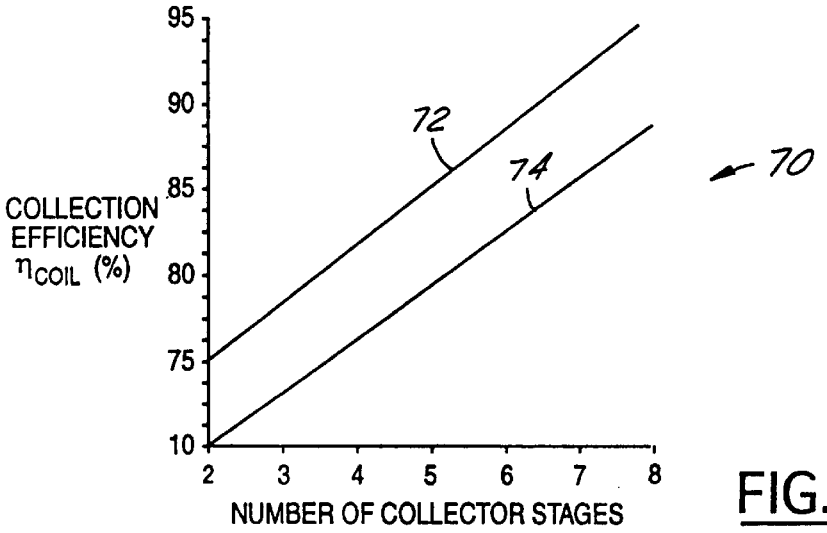
FIG. 5 is a cross-sectional view of the traveling wave tube shown in FIG. 1 along the line 5—5.
Figure 3:
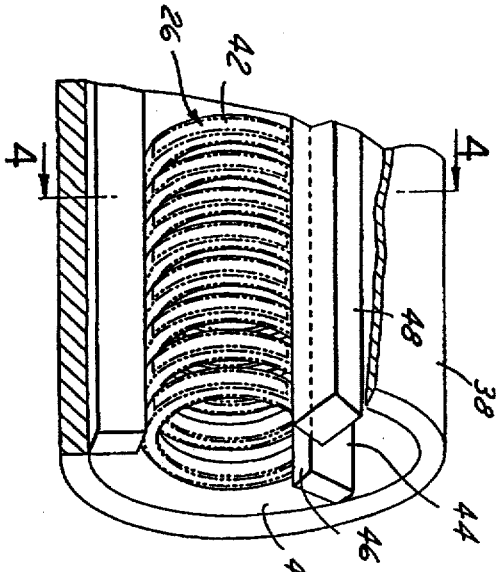
Figure 1:
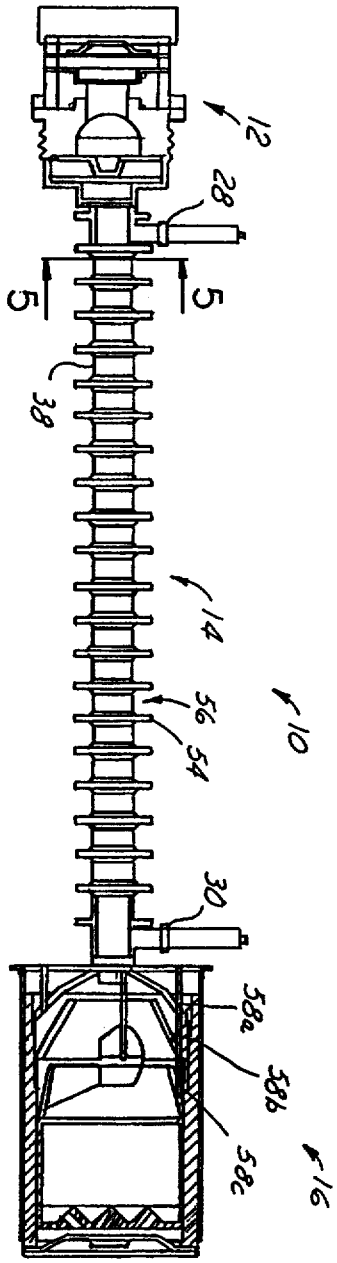
Figure 4:
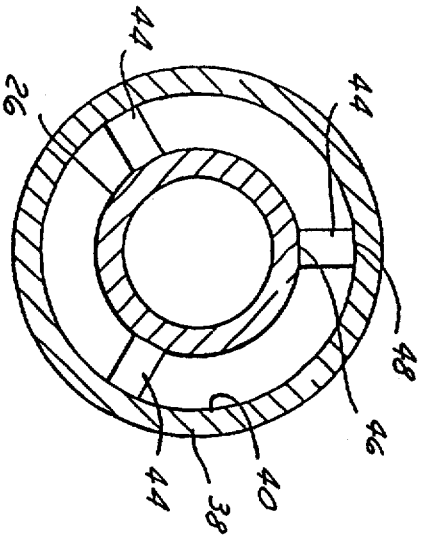
Figure 2:
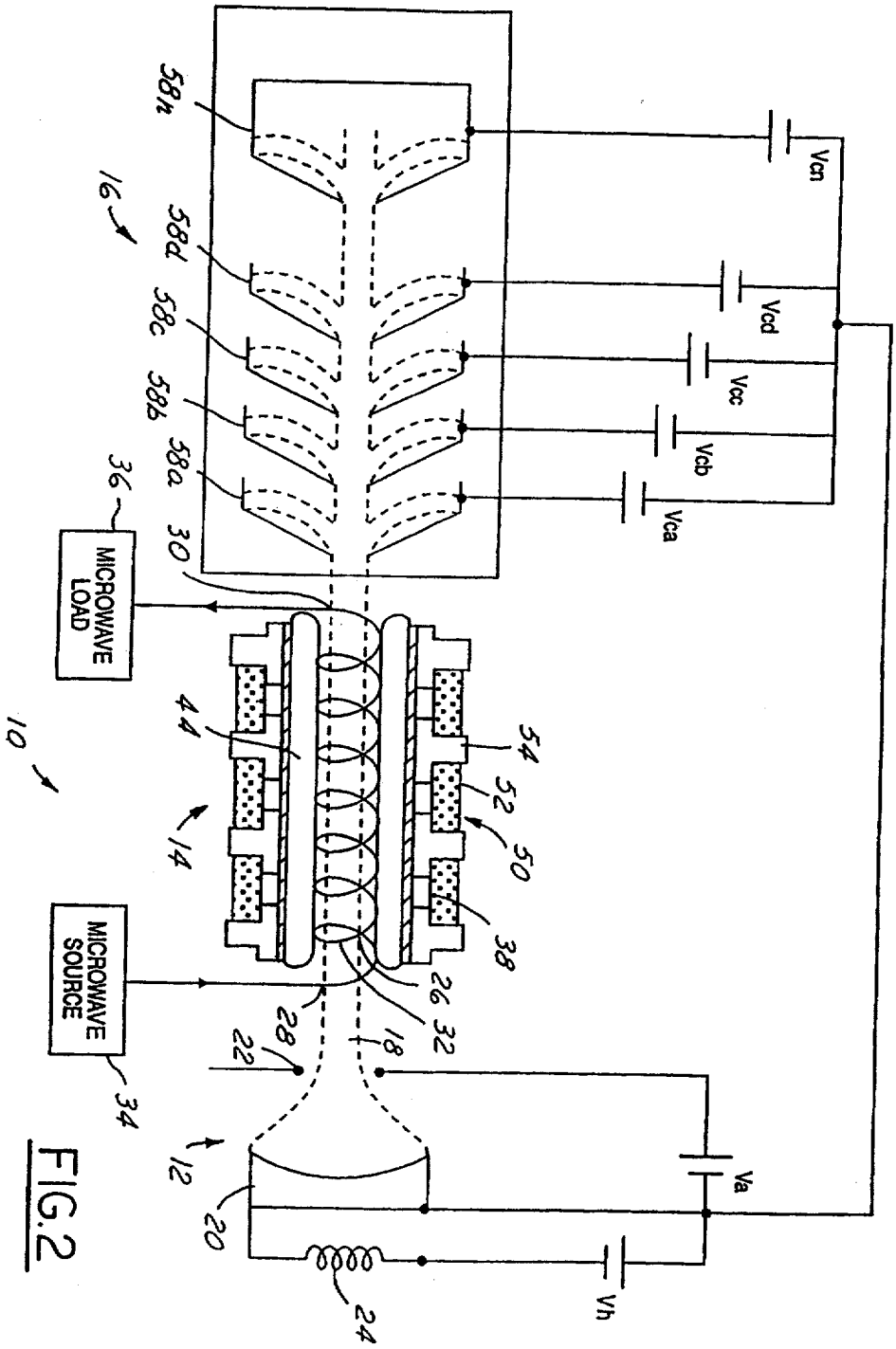
Figure 5:
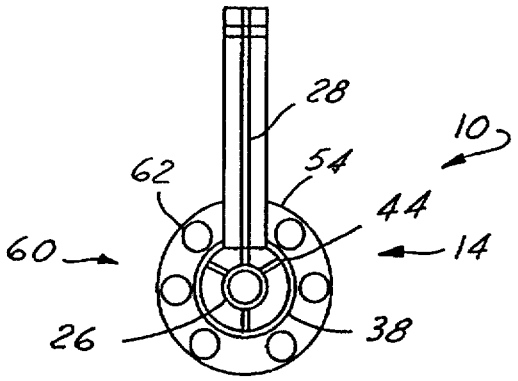
Figure 6:
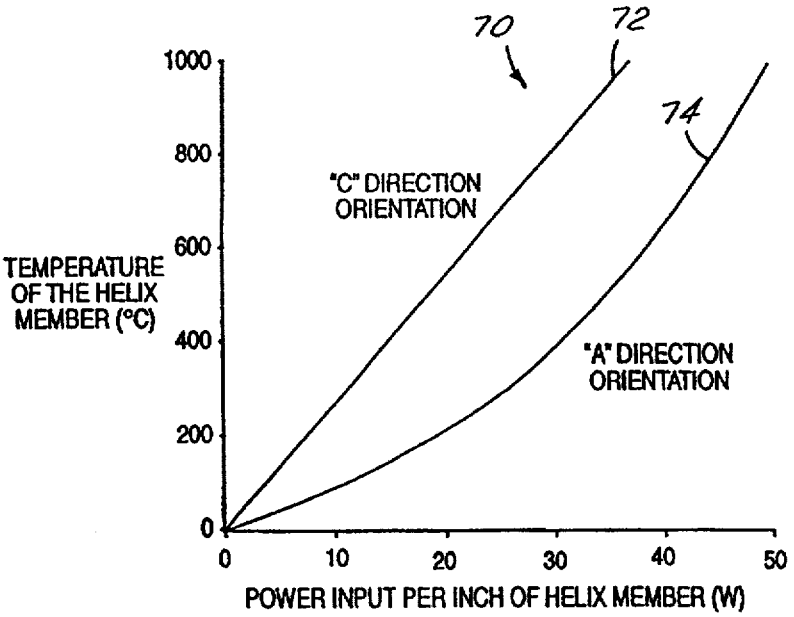

Referring now to FIG. 5, a cross-sectional view of SWS 14 of traveling wave tube 10 with a preferred PPM arrangement 60 is shown. PPM arrangement 60 is located outside the vacuum environment of tube member 38 and includes small disk magnets 62 instead of full cylinder magnets like magnets 52 shown in FIG. 2. Disk magnets 62 are only 0.25" in diameter, but provide sufficient magnetic flux to confine electron beam 18 during operation at back off. The magnetic field from magnets 62 is made azimuthally uniform inside tube member 38 by pole pieces 54 positioned between each magnet cell in the PPM stack. Of course, PPM arrangement 60 could include full cylinder magnets or other types of magnets.

Another benefit of operating backed off from saturation is that a smaller amount of heat is generated. Thus, BN supporting rods 44 are optimized for transporting the smaller amount of heat generated at back off away from helix member 26. Because of the optimization, BN supporting rods 44 are unable to remove the greater amount of heat generated at saturation. BN supporting rods 44 have a relatively low dielectric constant and provide a minimum amount of dispersion and microwave loading effects on helix member 26.

BN supporting rods 44 have a laminated structure. The direction parallel and the direction perpendicular to the layers are respectively referred to as the "A" and "C" directions. The physical and mechanical properties of BN supporting rods 44 differ widely between the "A" and "C" directions. For example, conduction of heat along the "A" direction is five to ten times better than conduction in the "C" direction. For this reason, BN supporting rods 44 are normally oriented such that the "A" direction is substantially perpendicular to the helix member to have the layers parallel to the heat flow for removing a maximum amount of heat.

However, supporting rods oriented in the "A" direction are more susceptible to fracturing from pressure compression between the helix and tube members. Fracturing leads to failure of the supporting rods and gas bursts in the traveling wave tube. This can result in failure of the traveling wave tube or, at the least, interruption of operation until the gas is removed. Thus, because of the minimal heat transferring requirements, supporting rods 44 are oriented in the "C" direction between helix member 26 and tube member 38. In this orientation, the "C" direction is substantially perpendicular to the helix member. Orienting supporting rods 44 in the "C" direction would be impossible if traveling wave tube 10 operated at saturation because helix member 26 would overheat from poor heat conduction along the "C" direction.

Figure 6:
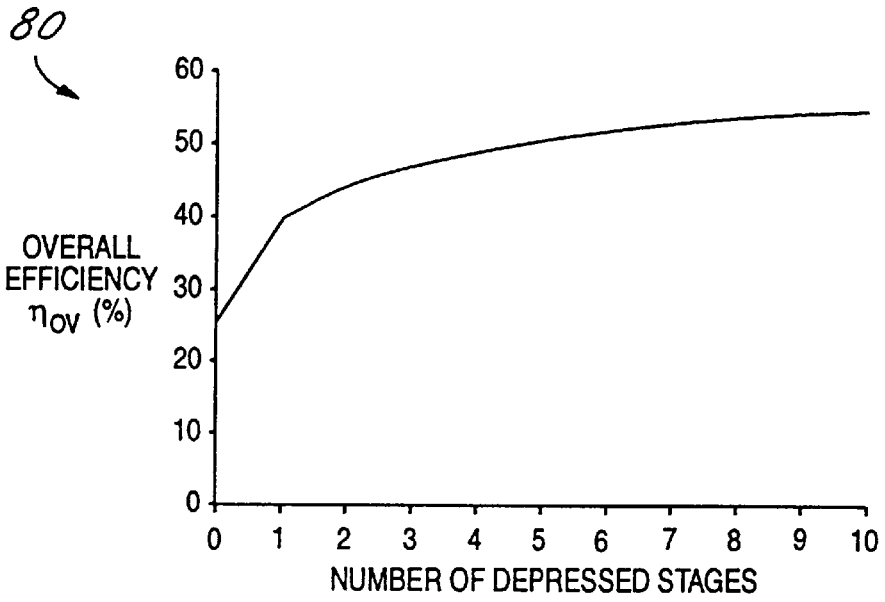
(PRIOR ART) FIG. 6
FIG. 6 is a graph illustrating the temperature of the helix member as a function of the power deposited on the helix member for two supporting rod orientations.

Referring now to FIG. 6, a graph 70 illustrating the temperature of the helix member as a function of the power deposited on the helix member for "A" and "C" direction supporting rods is shown. Graph 70 includes a plot 72 for a "C" direction supporting rod and a plot 74 for an "A" direction supporting rod. As shown in FIG. 6, for a given power input on a helix member, the temperature of the helix member with an "A" direction supporting rod is lower than the temperature with a "C" direction supporting rod. At saturation, the given power input on the helix member is high. By operating traveling wave tube 10 in the continuous mode backed off from saturation, the given power input is lower. Thus, at backed off operation, supporting rods 44 may be oriented in the "C" direction. Furthermore, the thickness of supporting rods 44 may be minimized to reduce microwave loading effects while still being able to provide proper heat transferring and mechanical supporting capabilities.

As shown, traveling wave tube 10 has many attendant advantages. Traveling wave tube 10 is designed for continuous operation backed off from saturation. Thus, a reduced number of components are needed for PPM arrangement 50. Also, supporting rods 44 may be oriented to resist fracturing while still being able to provide proper heat transferring.

It should be noted that the present invention may be used in a wide variety of different constructions encompassing many alternatives, modifications, and variations which are apparent to those with ordinary skill in the art. Accordingly, the present invention is intended to embrace all such alternatives, modifications, and variations as fall within the spirit and broad scope of the appended claims.

What is claimed is:

1. A traveling wave tube comprising:

a tube member;

a slow wave structure (SWS) located within the tube member, the SWS provided with an input end for receiving a microwave input signal having a power level and an output end for supplying a microwave output signal having a power level;

an electron gun assembly adjacent the input end of the SWS for injecting electrons as an electron beam along an axial path in the SWS; and a magnetic focusing device for generating a magnetic field having a strength to confine the electron beam to the axial path, wherein the strength of the magnetic field is sufficient to confine the electron beam only when the power level of the microwave input signal is selected such that the power level of the microwave output signal is at least 6 dB lower than a power level of the microwave output signal at saturation.

2. The tube of claim 1 wherein:

the SWS is a helix member.

3. The tube of claim 2 further comprising:

three Boron Nitride (BN) supporting rods engaged between the tube member and the helix member for supporting and transferring heat away from the helix member, each of the three BN supporting rods having a plurality of layers, wherein each of the three BN supporting rods is oriented in a direction perpendicular to the plurality of layers between the helix member and the tube member.

4. The tube of claim 1 wherein:

the magnetic focusing device is a periodic permanent magnet (PPM) arrangement.

5. A traveling wave tube comprising:

a tube member;

a helix member located within the tube member, the helix member provided with an input end for receiving a microwave input signal having a power level and an output end for supplying a microwave output signal having a power level;

an electron gun assembly adjacent the input end of the helix member for injecting electrons as an electron beam along an axial path through the helix member;

three Boron Nitride (BN) supporting rods engaged between the tube member and the helix member for supporting and transferring heat away from the helix member, each of the three BN supporting rods having a plurality of layers, wherein each of the three BN supporting rods is oriented in a direction perpendicular to the plurality of layers between the helix member and the tube member; and a magnetic focusing device for generating a magnetic field having a strength to confine the electron beam to the axial path, wherein the strength of the magnetic field is sufficient to confine the electron beam only when the power level of the microwave input signal is selected such that the power level of the microwave output signal is at least 6 dB lower than a power level of the microwave output signal at saturation.

6. The tube of claim 5 wherein:

the magnetic focusing device is a periodic permanent magnet (PPM) arrangement.

7. The tube of claim 6 wherein:

the PPM arrangement comprises a plurality of disk magnets.

8. The tube of claim 7 wherein:

the plurality of disk magnets consists of a minimal number of disk magnets sufficient to generate the magnetic field.

9. The tube of claim 5 wherein:

the electron beam has a power level and the power level of the microwave input signal is selected such that the power level of the microwave output signal is twenty to fifty times lower than the power level of the electron beam.

10. A method for operating a traveling wave tube provided with a slow wave structure (SWS) having an input end for receiving a microwave input signal having a power level and an output end for supplying a microwave output signal having a power level, the method comprising:

injecting electrons at the input end of the SWS to form an electron beam along an axial path through the SWS;

applying the microwave input signal to the input end of the SWS; and generating a magnetic field having a strength to confine the electron beam to the axial path, wherein the strength of the magnetic field is sufficient to confine the electron beam only when the power level of the microwave input signal is selected such that the power level of the microwave output signal is at least 6 dB lower than a power level of the microwave output signal at saturation.

11. The method of claim 10 wherein:

the electron beam has a power level and, further comprising selecting the power level of the microwave input signal such that the power level of the microwave output signal is twenty to fifty times lower than the power level of the electron beam.

* * * * *

UNITED STATES PATENT AND TRADEMARK OFFICE

CERTIFICATE OF CORRECTION

PATENT NO. : 5,932,971
DATED : August 3, 1999
INVENTOR(S) : Goebel et al.

It is certified that error appears in the above-identified patent and that said Letters Patent is hereby corrected as shown below:

Title page,
Add item [73] Assignee: Hughes Electronics Corporation El Segundo, California 90245-0956

Delete drawing sheets 1-3 and substitute therefor the drawing sheets 1-3 as shown on the attached pages.

Signed and Sealed this

Eighteenth Day of September, 2001

*Attest:*

Nicholas P. Godici

NICHOLAS P. GODICI
*Acting Director of the United States Patent and Trademark Office*

*Attesting Officer*